United States Patent [19]

Hepner

[11] 4,235,220

[45] Nov. 25, 1980

[54] COOKING STOVE EXHAUST AIR FILTRATION SYSTEM

[76] Inventor: Robert J. Hepner, 21458 Ellen Dr., Fairview Park, Ohio 44126

[21] Appl. No.: 46,228

[22] Filed: Jun. 7, 1979

[51] Int. Cl.[3] ..... F24C 15/20

[52] U.S. Cl. ..... 126/299 D; 55/208; 55/DIG. 36

[58] Field of Search ..... 98/115 R; 126/299 D; 55/DIG. 36, 208

[56] References Cited

U.S. PATENT DOCUMENTS

| | | | |
|---|---|---|---|
| 1,916,907 | 7/1933 | Sargent | 126/299 D |
| 2,563,042 | 8/1951 | Jaubert | 55/208 |
| 2,794,514 | 6/1957 | Risley | 126/299 D |
| 2,808,237 | 10/1957 | Fosnes | 126/299 D |
| 3,260,189 | 7/1966 | Jensen | 126/299 D |
| 3,381,453 | 5/1968 | Dills | 55/208 |
| 3,618,659 | 11/1971 | Rawal | 165/16 |
| 3,837,269 | 9/1974 | Sweet et al. | 126/299 E |
| 4,142,575 | 3/1979 | Glancy | 165/16 |
| 4,171,722 | 10/1979 | Huggins | 55/DIG. 36 |

*Primary Examiner*—Ronald C. Capossela

*Attorney, Agent, or Firm*—Meyer, Tilberry & Body

[57] ABSTRACT

An air filtration system for a cooking stove collects exhaust air from the stove with a vent hood, filters grease, particles and odors from the exhaust air and returns the filtered exhaust air to the room in which the stove is used. Exhaust air is cleansed of particles and odors by an activated charcoal filter within a return air conduit leading from the vent hood to the room. An electrically operated fan draws exhaust air into the vent hood, through grease filters and the activated charcoal filter and forces exhaust air back into the room. Regeneration of the activated charcoal filter is provided at selective intervals of time to maintain the effectiveness of the charcoal, and cooling of return air is provided for.

16 Claims, 4 Drawing Figures

COOKING STOVE EXHAUST AIR FILTRATION SYSTEM

BACKGROUND OF THE INVENTION

The present invention relates to an air filtration system for a cooking stove and, more particularly, to an air filtration system which filters exhaust air from a stove and returns the filtered exhaust air back into the room.

Exhaust air from cooking stoves consists of warm air containing grease, particulate matter and odors. It is desirable to remove this exhaust air from the immediate vicinity of the cooking stove so that the air supply does not become stale or rancid. For this purpose, cooking stoves are commonly provided with venting arrangements for exhausting air from the vicinity of the stove to atmosphere outside the building. Generally, a fan is used to draw air to be exhausted from the area in which the stove is used and expel the air to the exterior of the building. Filters for removing grease from the air are commonly included within the air filtration system.

Cooking stoves generally are divisible into two distinct classes of stoves, namely residential and commercial. Residential cooking stoves are used within a residential dwelling to prepare only a few meals per day for a small number of people. These residential stoves have a daily use generally in the range of two to four hours. Resultant exhaust air from residential stoves is therefore minimal and occurs for only short periods of time. Commercial cooking stoves, the second class, present different problems in view of the larger sizes, greater hourly use, and the quantity and variety of foods cooked thereby. Daily total use of a commercial stove can average eleven hours per day. The quantity of air exhausted from a commercial stove is therefore considerable and the air is exhausted continuously for extended periods of time.

Cooking stove air filtration systems which expel exhaust air to the exterior of a building present problems of replenishing the air supply within the building. In this respect, while the venting arrangement operates to exhaust air from the vicinity of the stove and thus the room, no provision is made for supplying fresh air to the room in quantities equivalent to the air eliminated. To some extent recirculation of exhaust air has been accomplished with regard to residential cooking stoves. In this respect, exhaust air is drawn through a charcoal filter by a fan and forced back into the room. Because of the relatively infrequent operation of a residential cooking stove, and the small quantity of air to be handled, the charcoal filter need only be capable of handling 100 to 200 cubic feet per minute of exhaust air. As a result, charcoal filters for use in residential stove venting arrangements are feasible. However, systems which may be considered adequate for residential cooking stoves do not provide sufficient filtering and recirculation in the environment of commercial cooking stoves. From the standpoint of size alone, commercial cooking stoves would require a charcoal filter accommodating up to 2000 cubic feet per minute of exhaust air. In addition, the continuous use of cooking stoves in commercial environments for extensive periods of time would cause quick deterioration of charcoal filters.

At present, most commercial stove venting arrangements merely expel the exhaust air into the atmosphere outside the building. As a result of the large quantity of exhaust air from a commercial stove, the air supply within the room could conceivably be depleted to an unacceptable or even unsafe level. While the room in which the commercial stove is being used is not necessarily sealed, the amount of air able to enter the room is extremely limited. Therefore, the large amounts of air drawn from the room by the venting arrangement decreases the air supply in the room to the possible detriment of occupants thereof.

One solution to the problem of decreasing air supply within a commercial kitchen involves introducing fresh, outside air into the room. While this solves the air supply problem, another serious problem is created. In this respect, while the heating or air conditioning system of the building is working to maintain the temperature within the building within a comfortable range for occupants thereof, fresh air from outside the building generally works against the heating or air conditioning systems. In cold weather, for example, the heating system of the building expends energy in the heating of the interior air. Thus, a system which supplies fresh exterior air, interjects cold air into the room, whereby more energy is required to heat the interior of the building. During warm weather, the building air conditioning system expends energy to cool the interior air of the building. Therefore, when warm outside air is supplied to the room, the building air conditioning system must expend additional energy to cool the warm air. In either event, the additional cooling or heating of the supplied external air hampers energy conservation.

As noted above, residential cooking stoves have included air filtration systems which recirculate filtered air back to the room in which the stove is being used. To effectively accomplish this feat, an air filtration system must remove grease, particles and odors from the exhaust air before returning the air to the room. The small size and limited use of stoves in residential applications enables relatively small sized charcoal filters to be used to purify the exhaust air for a period of time. With respect to commercial cooking stoves, however, the large volume of exhaust air and extensive use of the stoves has rendered charcoal filtering of the exhaust air unfeasible due to the size of filter required and the frequency of renewal of the charcoal.

SUMMARY OF THE INVENTION

The present invention provides an improved air filtration system for a commercial cooking stove which eliminates grease, particles and odors from exhaust air of the stove through a regenerative charcoal filter and returns the filtered air to the room. Filtration is accomplished by an improved combination of filters which cleanses the exhaust air for return to the interior atmosphere immediately adjacent the commercial cooking stove.

In accordance with a preferred embodiment of the invention, a vent hood is provided immediately above a commercial cooking stove. An exhaust air conduit leads from the vent hood, and serially arranged grease filters and an activated charcoal filter eliminate grease, particles and odors from exhaust air drawn through the hood and conduit. Exhaust air is drawn from the vicinity of the stove through the filters and thence back into the interior atmosphere of the room by an electrically operated fan. The grease filters prolong the useful life of the activated charcoal filter by eliminating grease and excessively large particles which might permanently clog the charcoal filter. Smaller particles and odors are eliminated from the exhaust air by passage through the activated charcoal filter. Regeneration of the activated charcoal filter is provided for and enables the use of a filter having practical and workable dimensions. Moreover, regeneration of the activated charcoal enables effectively spent activated charcoal to be cleansed for additional use in filtering.

Exterior venting of exhaust air is advantageously eliminated through use of the present invention, as is elimination of venting exterior air into the room. Thus, the quantity and quality of room air is maintained, and inefficient and uneconomical operation of heating or air conditioning systems of the building is avoided. In connection with the latter, it is preferred to provide for cooling of the exhaust air before return thereof to the room to maintain a desired temperature in the room, especially in warm weather. This can be achieved for example by a cooling coil in the air duct adjacent the outlet end thereof. Furthermore, the present invention eliminates the time and expense involved in erecting external vents from a commercial stove.

A primary object of the present invention is to provide an improved air filtration system for a cooking stove.

Another object of the present invention is to provide an improved air filtration system for a commercial cooking stove which is economical to construct, maintain and operate.

Still another object of the present invention is to provide an improved air filtration system which enables the quantity and quality of air in a room to be maintained despite the use of a cooking stove therein.

Another object of the present invention is to provide an improved air filtration system in which the identical quantity of air removed by the air filtration system as exhaust air is returned to the room after cleaning and freshening by the air filtration system.

Another object of the present invention is to provide an improved air filtration system in which filters including an activated charcoal filter are used to effectively eliminate particles and odors from exhaust air of a commercial stove for recirculation into the room in which the stove is used.

Yet another object of the present invention is to provide an improved air filtration system of the foregoing character in which the activated charcoal filter is adapted to be regenerated.

Yet another object of the present invention is to provide an improved air filtration system in which a relatively large volume of exhaust air from a commercial cooking stove is vented from the room and returned after filtering and in which the returned air is adapted to be cooled in the air filtration system.

BRIEF DESCRIPTION OF THE DRAWINGS

The invention may take physical form in a variety of parts and arrangements of parts, preferred embodiments of which will be described in the following specification and are illustrated in the accompanying drawings which form a part hereof and wherein.

DETAILED DESCRIPTION OF THE PREFERRED EMBODIMENT

Figure 1:
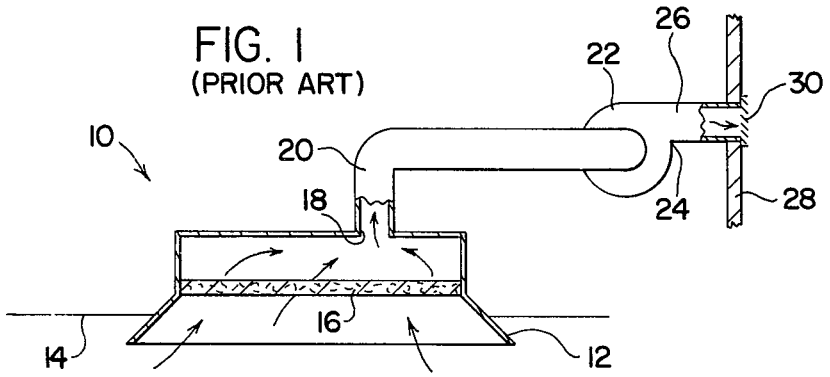
FIG. 1 (PRIOR ART)
FIG. 1 is a side elevation view, partially in section, of one air filtration system constructed in accordance with the prior art.

Referring now to the drawings wherein the showings are for the purpose of illustrating preferred embodiments of the invention only and not for the purpose of limiting the invention, FIG. 1 shows a prior art air filtration system 10 which includes a vent hood 12 projecting through a ceiling 14 into a room containing a cooking stove (not shown). Vent hood 12 is generally located in a position directly over the cooking stove such that exhaust air from the stove ascends into the vent hood. Removably positioned within vent hood 12 is a filter 16 for eliminating grease from the exhaust air ascending from the stove. Generally, such a filter is constructed of expanded metal. An opening 18 in an upper surface of the vent hood is connected to an exhaust air conduit 20 in which an electrically operated fan 22 is provided to draw exhaust air into vent hood 12 and conduit 20. Fan 22 has an outlet 24 connected by a vent conduit 26 through an exterior wall 28 of the building. Vent conduit 26 is provided with a venting cover 30 on the outer end thereof to seal the vent conduit against back flow of outside air therethrough. When fan 22 is operated, exhaust air enters vent hood 12 and is drawn through exhaust air conduit 20 and forced out venting cover 30 into the exterior atmosphere. Such prior art systems result in constant flow of air from the room and adversely effect the supply of air within the room. While most commercial kitchens are not necessarily sealed air-tight, they are generally closed. If no air inlet is provided in association with the air filtration system 10, the constant flow of air from the room results in a shortage of air supply for occupants within the room.

Figure 2:
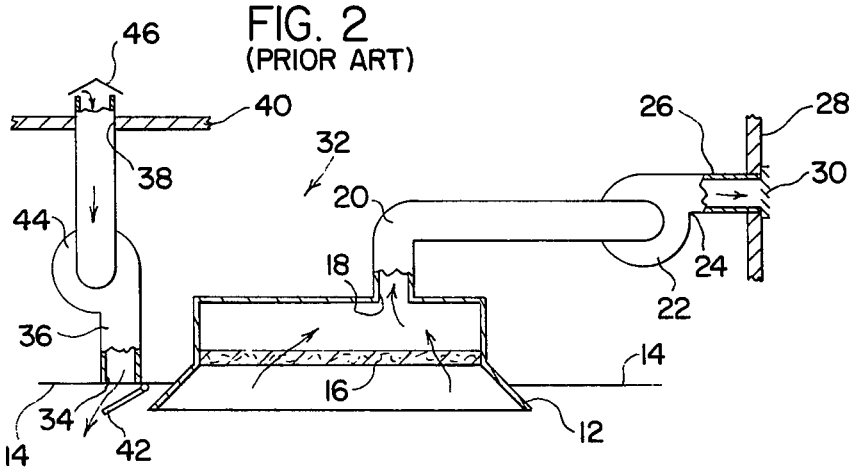
FIG. 2 (PRIOR ART)
FIG. 2 is a side elevation view, partially in section, of another prior art air filtration system.

As a solution to the problems of air supply within the room, an alternate prior art air filtration system 32 is shown in FIG. 2, wherein like numerals are employed to designate like component parts of the system shown in FIG. 1. In FIG. 2, vent hood 12 projects through ceiling 14 of a room immediately above a cooking stove (not shown). As in FIG. 1, filter 16 is provided to remove grease from exhaust air drawn into vent hood 12, and opening 18 of the vent hood directs the exhaust air into exhaust air conduit 20. Fan 22 draws the exhaust air through the exhaust air conduit and forces the air from outlet 24, into vent conduit 26 and through venting cover 30. In this instance, an additional opening 34, provided through ceiling 14, is connected by a duct 36 to an opening 38 is an exterior building wall 40. Duct 36 is provided with a vent cover 42 to prevent the escape of room air through the duct, a fan 44 and a vent cap 46 across the open outer end of the duct. Fresh air is drawn into duct 36 and forced into the room by fan 44. While a solution to the problem of air supply is provided by air filtration system 32, air from outside the building is forced into the room through vent cap 42 in direct contravention to the conditioning of the air in the room by a heating or cooling system.

Figure 3:
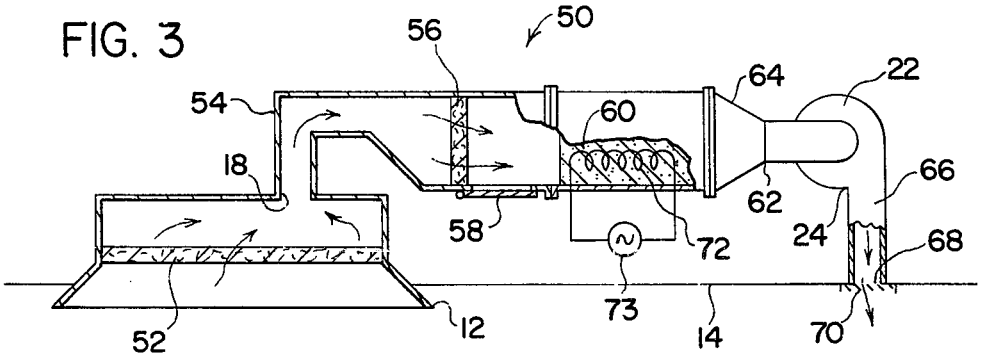
FIG. 3 is a side elevation view, partially in section, of an air filtration system for a stove constructed in accordance with the present invention; and, FIG. 4 is a side elevation view, partially in section, illustrating another embodiment of an air filtration system in accordance with the present invention.

FIG. 3 illustrates an air filtration system 50 constructed in accordance with the present invention. Again, like numerals designate component parts corresponding to those in FIGS. 1 and 2. Vent hood 12, in FIG. 3, projects through ceiling 14 into the room above a cooking stove (not shown). The vent hood includes a primary grease filter 52 for removing grease from exhaust air drawn into vent hood 12 from the cooking stove. Primary grease filter 52 consists of a number of layers of expanded metal screen, arranged immediately adjacent to one another and supported in a suitable frame structure within the vent hood such that the filter may be removed for cleaning or replacement. Opening 18 at the upper portion of vent hood 12 connects to an exhaust air conduit 54.

A secondary grease filter 56 is located within exhaust air conduit 54 downstream of primary grease filter 52 relative to the direction of air flow through the conduit. Secondary grease filter 56 is similar in construction to primary grease filter 52 and as such includes a number of layers of expanded metal screen immediately adjacent to one another, supported in a suitable frame structure. In the immediate vicinity of secondary grease filter 56, an access door 58 is provided through exhaust air conduit 54 for the purpose of allowing secondary grease filter 56 to be removed, cleaned and/or replaced at necessary intervals of time. Primary grease filter 52 is located directly above the cooking stove within vent 12 such that grease and heat from the cooking stove are constantly in contact with filter 52. The characteristics of expanded metal screen filters are generally known to decrease the effectiveness of the filtering process with a rise in temperature. For this reason, secondary grease filter 56 is provided at a location downstream from primary grease filter 52 to effect more thorough cleaning of the exhaust air as a result of separation of the secondary grease filter from the direct heat of the stove.

Also, within exhaust air conduit 54 is an activated charcoal filter 60 positioned so as to require all of the exhaust air flowing through the air conduit to be drawn through the activated charcoal filter. Essentially, all particles and odors remaining in the exhaust air at this point are eliminated by the flow of the exhaust air through activated charcoal filter 60. Secondary grease filter 56 increases the effective useful life of activated charcoal filter 60 by the elimination of grease and larger particles which avoid the primary grease filter.

While the activated charcoal filter may have any of a number of designs or forms, standardized filter cells are preferably used to increase efficiency of manufacture and decrease cost. In this regard, the preferred activated charcoal filter is composed of a series of standard charcoal cells measuring approximately eleven and one-half inches tall, by twenty-four and one-half inches wide by one inch thick. Each cell weighs approximately seven and one-half pounds. The charcoal within the cells is in chunk form specified as 8-14 standard mesh sifted. Activated charcoal filter 60 comprises twenty such cells, arranged in immediately abutting relationship, enabling 2000 cubic feet per minute of exhaust air to be filtered.

Conduit 54 at the downstream end of the activated charcoal filter is connected to input side 62 of fan 22 by a shroud 64. In this embodiment, the output 24 of fan 22 has a discharge conduit 66 which extends through an opening 68 in ceiling 14. Thus, all of the exhaust air flowing through activated charcoal filter 60 is forced by fan 22 back into the room. Opening 68 through the ceiling preferably is sealed by a normally closed vent cover 70. Such normally closed vent covers are known in the art and operate as one way valves by reason of spring biasing of the cover to close the opening. The spring bias is overcome by air flow thereagainst whereby, in the present embodiment, air forced through discharge conduit 66 by fan 22 can flow into the room and, when fan 22 stops, cover 70 closes to prevent backflow of room air into conduits 66 and 54.

Activated charcoal filter 60 is provided with an electrically operated resistance heating element 72 which is preferably positioned within air conduit 54 immediately adjacent to activated charcoal filter 60 and which operates when energized to regenerate the activated charcoal filter. While the heating element could be embedded in the charcoal of activated charcoal filter 60, such an arrangement would require a specially manufactured filter at possibly additional cost. It will be appreciated that heating element 72 is connected to a source of electrical power 73 and that appropriate controls, not shown, are provided for energizing and de-energizing the heating element. One characteristic of activated charcoal is that impurities therein can be eliminated by heating the activated charcoal to a specified temperature, preferably approximately 485° F. Resistance heating element 72 is selectively operated at appropriate intervals of time to renew the activated charcoal through regeneration.

In use, air filtration system 50 draws hot, particle and grease laden air from the room and returns the same air to the room, after thorough cleaning. Thorough cleaning of the exhaust air occurs as a result of primary grease filter 52 immediately adjacent the cooking stove removing heavy grease from the exhaust air, secondary grease filter 56 removing remaining grease and large particles from the exhaust air and activated charcoal filter 60 eliminating remaining particles and all odors from the exhaust air. Through the use of air filtration system 50, availability of air within the room does not decrease, while exhaust air from a cooking stove is thoroughly cleaned before being reintroduced into the room. Further, the quantity of air returned to the room is identical to the quantity withdrawn by the air filtration system 50. Regeneration of activated charcoal filter 60 enables effective filtering of exhaust air for a considerable period of time without replacement of the charcoal filter. While activated charcoal filter 60 is capable of filtering exhaust air at the rate of 2000 cubic feet per minute, system 50 is preferably arranged to process only 1200 cubic feet per minute of exhaust air. In this respect, the useful life of the charcoal filter is prolonged.

Figure 4:
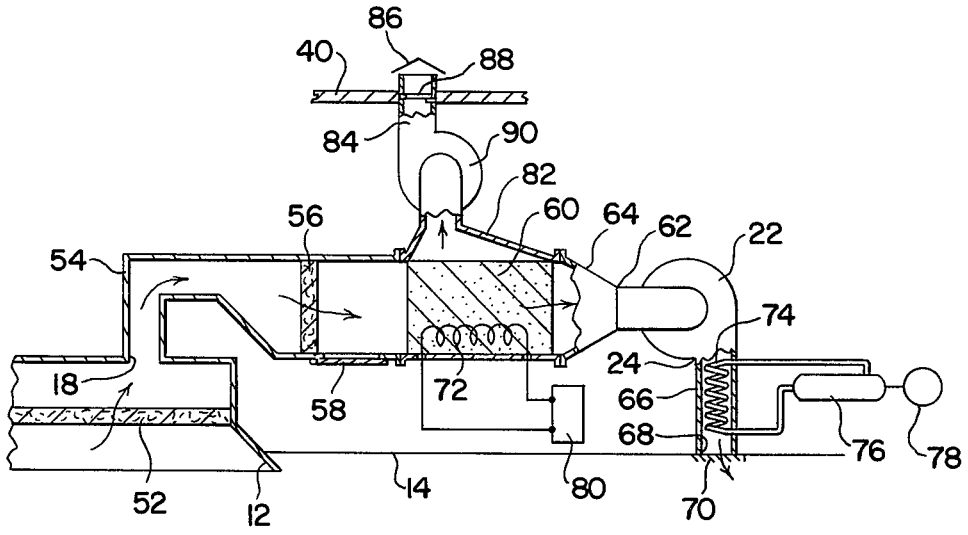

FIG. 4 represents an embodiment of the present invention involving a modification of air filtration system 50 illustrated in FIG. 3 for situations in which the room in which the stove is located is being treated by an air conditioning system for the purpose of cooling the interior atmosphere. In such a situation, the reintroduction of exhaust air at an increased temperature works against the intended cooling. Preferably, the exhaust air reintroduced into the room should be at the same or a lower temperature than the internal temperature of the room when the room is being so cooled. In order to accomplish this purpose, as seen in FIG. 4, a cooling coil 74 is provided within discharge conduit 66 intermediate fan 22 and opening 68 in the ceiling. Cooling coil 74 is connected to a refrigeration unit 76, whereby cooling fluid is circulated through the coil for the purpose of cooling the exhaust air within discharge conduit 66 before reintroduction into the room. Refrigeration unit 76 is adapted to be selectively operated at and/or for specific intervals of time and preferably by a suitable control unit 78. Control devices for such purposes are well known in the art and accordingly not illustrated herein.

FIG. 4 also illustrates modifications with respect to the portion of the air filtration system 50 comprising activated charcoal filter 60. In this respect, resistance heating element 72 is adapted to be operated by a control unit 80 for specific periods of time, and at selected intervals. More particularly in this respect, regeneration of activated charcoal filter 60 is generally accomplished during times that air filtration system 50 is not in use. In this regard, fan 22 is not drawing air through exhaust air conduit 54 and the activated charcoal filter. Thus, it will be appreciated for example that resistance heating element 72 could be energized through control unit 80 in response to de-energization of fan 22. With further regard to regeneration of activated charcoal filter 60, the heat supplied through resistance heating element 72 produces combustion by-products which, preferably, are vented to atmosphere. For this purpose, as shown in FIG. 4, a venting shroud 82 and duct 84 are provided over activated charcoal filter 60 for collecting and exhausting the combustion by-products from heating of the activated charcoal. Duct 84 exits through exterior building wall 40 and is provided with a venting cap 86. Venting cap 86 includes a one-way valve mechanism 88 which allows by-products of regeneration to exit through exterior wall 40, but does not permit exterior atmosphere to enter the building. In this respect, it is not desired that exterior air be able to enter the room through duct 84 and venting cap 86 to counteract the building heating or air conditioning. Further, the regeneration by-products are not desired to reenter the room. It will be appreciated that, during regeneration, combustion by-products are drawn into venting shroud 82, through duct 84 and forced into the atmosphere by a fan 90.

While considerable emphasis has been placed herein on preferred embodiments of the invention and the specific structures and structural interrelationships of the component parts thereof, it will be readily apparent that many embodiments of the invention can be made, and that many changes can be made in the embodiments herein illustrated and described without departing from the principles of the invention. Accordingly, it is to be distinctly understood that the foregoing descriptive matter is to be interpreted merely as illustrative of the invention and not as a limitation.

Having thus described the invention, it is claimed:

1. An air filtration system for a cooking stove including a vent hood for collecting exhaust air from a room in which a stove is used, air conduit means for said exhaust air, said air conduit means having an inlet at said vent hood, a motor operated fan within said air conduit means for drawing the exhaust air through said air conduit means, and at least one degreasing filter for removing grease from the exhaust air as the air is drawn into said vent hood through said air conduit means, the improvement comprising: said air conduit means having an outlet end opening into said room, an activated charcoal filter in said air conduit means between said inlet end and outlet end, and electrical resistance heating means for regenerating said activated charcoal filter, said electrical resistance heating means including a heating element embedded within said activated charcoal filter.

2. The improvement according to claim 1 wherein said electrical resistance heating means includes electrical control means for selectively energizing said heating element.

3. The improvement according to claim 1 including venting means for collecting and exhausting by products from regeneration of said activated charcoal filter.

4. The improvement according to claim 1 including a cooling coil located within said air conduit means, refrigeration means connected to said cooling coil for supplying coolant to said cooling coil, and control means for selectively operating said refrigeration means for cooling said exhaust air for return to said room.

5. The improvement according to clfilter, a cooling coil located within said air conduit means, refrigeration means connected to said cooling coil for supplying coolant to said cooling coil, and control means for selectively operating said refrigeration means for cooling said exhaust air for return to said room.

6. The improvement according to claim 1 including a first and second degreasing filter, said first degreasing filter located within said vent hood, said second degreasing filter located immediately prior to said activated charcoal filter within said air conduit means, said air conduit means having an opening allowing access to said second degreasing filter.

7. The improvement according to claim 1 including venting means for collecting and exhausting by products from regeneration of said activated charcoal filter, and first and second degreasing filters, said first degreasing filter located within said vent hood, said second degreasing filter located immediately prior to said activated charcoal filter within said air conduit means, said air conduit means having an opening allowing access to said second degreasing filter.

8. The improvement according to claim 1 including first and second degreasing filters, said first degreasing filter located within said vent hood, said second degreasing filter located immediately prior to said activated charcoal filter within said air conduit means, said air conduit means having an opening allowing access to said second degreasing filter, a cooling coil located within said air conduit means, refrigeration means connected to said cooling coil for supplying coolant to said cooling coil, control means for selectively operating said refrigeration means for cooling said exhaust air for return to said room, and venting means for collecting and exhausting by products from regeneration from of said activated charcoal filter.

9. A method of recycling exhaust air from a room in which a cooking stove is used, the method comprising the steps of: providing a vent hood for collecting air to be exhausted, preliminarily filtering particles of grease from the exhaust air collected by said vent hood, drawing preliminarily filtered exhaust air into an air conduit means for confining exhaust air, providing an activated charcoal filter within said air conduit means, drawing the preliminarily filtered exhaust air through said activated charcoal filter to remove substantially all particulate matter and substantially all odors from said exhaust air, periodically regenerating said activated charcoal filter by heating said activating charcoal filter with electrical resistance heating coil means embedded in said charcoal filter, and returning substantially all said exhaust air to said room after being drawn through said activated charcoal filter.

10. The method according to claim 9 wherein said preliminary filtering of particles of grease includes filtering by a first degreasing filter located at said vent hood, and filtering by a second degreasing filter located within said air conduit means immediately prior to said activated charcoal filter.

11. The method according to claim 10 wherein regenerating said charcoal filter includes controlling electrical power supplied to said heating coil means and venting by-products from the heating of said activated charcoal filter to atmosphere.

12. The method according to claim 10 including cooling said exhaust air within said air conduit means before returning said exhaust air to said room.

13. The method according to claim 10 including controlling electrical power supplied to said heating coil means, venting by-products from the heating of said activated charcoal filter to atmosphere and cooling said exhaust air within said conduit means before returning said exhaust air to said room.

14. The method according to claim 9 wherein regenerating said activated charcoal filter includes controlling electrical power supplied to said heating coil means.

15. The method according to claim 14 further including venting by-products from the heating of said activated charcoal filter to atmosphere.

16. The method according to claim 9 including cooling said exhaust air within said air conduit means before returning said exhaust air to said room.

* * * * *

UNITED STATES PATENT AND TRADEMARK OFFICE

CERTIFICATE OF CORRECTION

PATENT NO. : 4,235,220

DATED : November 25, 1980

INVENTOR(S) : Robert J. Hepner

It is certified that error appears in the above-identified patent and that said Letters Patent are hereby corrected as shown below:

Column 4, line 32, "effect" should read -- affect --; line 60, "cap" should read -- cover --. Column 8, line 10, claim 5, "clfilter" should read -- claim 1 including venting means for collecting and exhausting by-products from regeneration of said activated charcoal filter --; line 44, claim 8, delete "from" (second occurrence).

Signed and Sealed this

*Twenty-fourth* Day of *March 1981*

[SEAL]

*Attest:*

RENE D. TEGTMEYER

*Attesting Officer*

*Acting Commissioner of Patents and Trademarks*